United States Patent [19]

Vossen

[11] 3,999,694

[45] Dec. 28, 1976

[54] SEVERING USEFUL LENGTHS INTERCONNECTED THROUGH SMALL FILLETS IN A SHEET OF PAPER

[76] Inventor: Franz Vossen, Op dem Felde 26, 4055 Niederkruchten, Germany

[22] Filed: Jan. 29, 1975

[21] Appl. No.: 545,181

[30] Foreign Application Priority Data

Feb. 1, 1974 Germany ..... 2404840

[52] U.S. Cl. ..... 225/100; 225/97; 225/106

[51] Int. Cl.[2] ..... B26F 3/00

[58] Field of Search ..... 225/2–5, 225/94, 97, 100–104, 106

[56] References Cited

UNITED STATES PATENTS

| | | | |
|---|---|---|---|
| 2,711,793 | 6/1955 | Zalkind | 225/101 |
| 3,658,220 | 4/1972 | Norton | 225/100 X |
| 3,895,751 | 7/1975 | Shepherd | 225/101 X |

FOREIGN PATENTS OR APPLICATIONS

| | | | |
|---|---|---|---|
| 1,252,050 | 12/1967 | Germany | 225/101 |

*Primary Examiner*—Leonidas Vlachos
*Assistant Examiner*—Fred A. Silverberg
*Attorney, Agent, or Firm*—Lerner, David, Littenberg & Samuel

[57] ABSTRACT

A method of severing useful lengths connected together by small fillets in a sheet of paper, pasteboard or the like, comprises applying the sheets on to a substantially non-flexible support having a contact surface of a first coefficient of friction, and then exerting on adjacent useful lengths, through forces which act in opposite directions tangentially on said adjacent useful lengths with a contact pressure by way of a second coefficient of friction exceeding the value of said first coefficient of friction, a splaying movement sufficient to destroy the fillets. Apparatus for carrying out the method may comprise a press, pressure fingers disposed at both sides of the longitudinal axis of said press, and contact surfaces having said comparatively high second coefficient of friction and at the free ends of said pressure fingers, said contact surfaces being intended for application to the useful lengths to be severed. The pressure fingers may be adapted to be moved away from one another in a plane substantially perpendicular to the principal plane of said useful lengths and the plane of separation between said useful lengths, a spring counteracting said movement of said pressure fingers as a function of downward movement of said press with increase of the spacing between the contact surfaces. Alternatively, there may be means for applying an additional and external force independent of the force applying the press to said useful lengths, said additional force being displaceable in a direction substantially tangential to the principal plane of said useful lengths.

10 Claims, 10 Drawing Figures

SEVERING USEFUL LENGTHS INTERCONNECTED THROUGH SMALL FILLETS IN A SHEET OF PAPER

BACKGROUND OF THE INVENTION

The present invention concerns a method of severing useful lengths interconnected through small fillets in a sheet of paper, paperboard, pasteboard or the like, as well as apparatus for carrying out such a method.

The severing of useful lengths still interconnected after the actual punching operation by the aforesaid small fillets has heretofore been effected somewhat in the manner that a matrix with knifelike ridges was arranged at the underside of a sheet containing the useful lengths, the kniflike ridges extending along the separating lines or punched sides of the useful lengths. The sheet was pressed in a downwards direction from above this matrix so that the knifelike ridges gripped along the separating lines between the useful lengths and thus could destroy the small fillets. Special pressure fingers acting downwards from the upper side of the sheet were provided for pressing down the sheet on to the separating matrix. That made it necessary to make a special separating matrix for each pattern of cutting, which is to be considered as disadvantageous also insofar as the costs for such a matrix are not inconsiderable and may lie in the order of magnitude of $2000.

There is known from West German Patent Specification 2,310,021, as laid open to inspection, apparatus for separating useful lengths which are interconnected through small fillets, in which apparatus the adjacent useful lengths are held between upper and lower conveying devices and then simply drawn apart by these so that the fillets are broken. The conveyor units are displaceable transverse to the direction of movement of the products to be taken off, so that in this case, adaptation to the form of the products at any time is possible. The separating device, according to West German Patent Specification 2,310,021 as open to inspection, makes it possible therefore to offer what is basically a universal application which, however, requires in practice, a considerable amount of additional space and, moreover, a large technical expenditure so that high production costs which may amount to $60,000 arise, whereby an economical utilization is frequently prohibited as a matter of course. Added to this is the comparatively complicated construction of the known separating device which naturally makes necessary considerable continuous maintenance work.

SUMMARY OF THE INVENTION

The object of the present invention is so to organize a method and an apparatus of the known kind first mentioned, that not only can work be carried out independently of the cutting pattern at any time and a possibility of universal adjustment is available, but at the same time also smaller susceptibility of trouble and especially lower costs of production than hitherto are guaranteed.

This object is met, according to the present invention, by applying the sheet on to a substantial non-flexible support that surface of which the sheet is applied having a first coefficient of friction, and then, through forces acting with a higher second coefficient of friction in opposite directions tangential to adjacent useful lengths with contact pressure adapted to overcome the contact pressure conditional on the first coefficient of friction, exerting a spreading movement on the adjacent useful lengths sufficient to destroy the fillets.

The substantially non-flexible support may be formed by the pad itself on which the sheets containing the useful lengths are supported, or even by sheets already included in a stack, particularly the uppermost sheet of the stack.

It is thus no longer necessary to engage directly in the region of the separating lines or the fillets still connecting the useful lengths together with an exactly adjusted knifelike separating device. Furthermore, there is no need to grip adjacent useful lengths at any time, firstly between an upper and a lower conveying device, and then to effect local separation of the useful lengths clamped between the conveyor units in order to destroy the fillets. Rather it is sufficient to exert pressure on the upper side of the sheet with the useful lenghts to be separated, in cooperation with the support therebelow, to provide for adhesion between the medium exerting the pressure and the sheet, while the coefficient of friction of the contact surface of the substantially non-flexible support is sufficiently small in order to permit lateral displacement of the sheet relative to the support. As soon as this condition is provided, it is sufficient to exert on the pressure points, for a short time, forces directed transverse to the separating line with the fillets so that the desired destruction of the fillets comes about. After this destruction, the force directed transverse to the separating line can again be released so that the useful lengths separated from one another return to their original position. Substantially the whole product surface is available for application of the tangential forces so that it is possible to work with very great tolerances without having to accept any kind of deterioration of the product. It is thus possible to carry out the method, according to the invention, not only with considerably low costs, but also with greater reliability and especially guite independent in every way from the nature of the cutting at any time.

Preferably, the tangential forces are formed by a force directed substantially perpendicular to the principal plane of the useful lengths by rerouting that force which creates the contact pressure, so that in this case there need only be one source of power effective in the direction normal to the principal plane of the useful lengths. Moreover there is also the possibility of catering for the contact pressure by means of a first power directed substantially normal to the principal plane of the useful lengths and then to effect separation of the useful lengths by means of a second power directed substantially parallel to the main plane of the useful length and opposed to the contact pressure points.

Apparatus suitable for carrying out the method according to the invention in a particular way is characterised by a press with press fingers arranged on both sides of its longitudinal axis, which fingers at their free ends extend into contact surfaces of comparably high coefficient of friction and intended for application to the useful lengths to be separated from one another, said contact surfaces being movable away from one another in a plane substantially perpendicular to the principal plane of the useful lengths and to the dividing line between the useful lengths against the action of a spring as a function of a lowering movement of the press with increase of the distance between the contact surfaces. This press needs then only to be applied with the two gripping surfaces to adjacent useful lengths and then lowered in order to separate from one another the interconnecting useful lengths, the gripping surfaces taking the useful lengths with them as a result of the high second coefficient of friction and separating them from one another with destruction of the small fillets.

DESCRIPTION OF DRAWINGS

Further features of the invention will be apparent from the subordinate claims.

Embodiments of the invention will now be described, by way of example, with reference to the accompanying drawings, in which.

DETAILED DESCRIPTION

Figure 1:
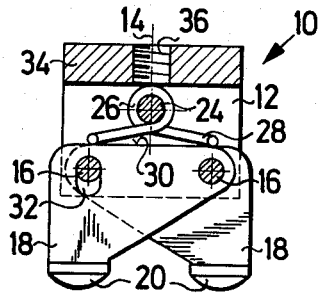
FIG. 1 is a side sectional elevation of a preferred embodiment of apparatus for carrying out the method according to the invention.

Referring now to the drawings, and firstly to FIG. 1 thereof, apparatus especially suited for carrying out the method according to the invention is in the form of a press generally denoted 10. The press 10 includes a press body 12 which has a U-shaped cross-section (not shown) with a yoke or crossbar 34 and side pieces extending therefrom. On both sides of a longitudinal axis 14 of the press body 12, two pins 16 extend between the two parallel side pieces issuing from the yoke 14, pressure fingers 18 being pivoted about the pins 16. Both pressure fingers 18 terminate at their free ends in engaging surfaces 20 which are covered with or formed by a material which has a coefficient of friction somewhat like rubber. Above the two pressure fingers 18, which are substantially triangular in shape, there is a journal 24 providing a bearing for a spring 26, the journal 24 extending parallel to the pins 16. The spring 26 engages with two symmetrical arms 28 the rear faces of the two pressure fingers 18. The areas of the pressure fingers 18 projecting beyond the pins 16, the rear faces of which pressure fingers are engaged with initial tension by the arms 28 of the spring, are provided in the vicinity of the pins 16 with elongate slots 32. If the press 10 of FIG. 1 is now pressed downwards, the engaging surfaces 20 are applied to adjacent useful lengths (as is indicated in some way in FIGS. 5 and 9), the left-hand pressure finger 18 swivels in the clockwise direction about the pin 16 to the right in the drawing, while the opposite holds for the right-hand pressure finger 18 in FIG. 1. The elongate slots 32 (which naturally are provided in both pressure fingers 18), in association with the pin 16 acting as journal for whichever pressure finger 18 is the other at any time, take care through their lengths for the extent of the outwards travelling movement of the pressure fingers 18 and for restriction of such movement. Through the swivelling of the pressure fingers 18, one in the clockwise sense and the other in the anti-clockwise sense, the engaging surfaces 20 move away from one another, and as they take with them the useful lengths resting against same with static friction, the desired removal of the useful lengths from one another is achieved as a result of the downward movement of the press 10.

A screw-thread 36 may be provided in the yoke 34, in order to screw the press 10 on to a suitable pressure-transferring shank.

Figure 2:
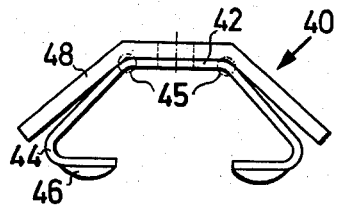
FIGS. 2 to 4 are views corresponding to FIG. 1 of further embodiments of apparatus according to the invention.

FIG. 2 shows a press 40 as another embodiment of the invention. The press 40 has a bar 42 which corresponds somewhat to the press body 12 of FIG. 1. At both of its outer transverse edges the bar 42 goes over into pressure fingers 44, which, for their part, run into engaging surfaces 46. The bar 42, the pressure fingers 44 and the engaging surface 46 in this way form a somewhat C-shaped member, which may be produced throughout from spring steel, the transitions between the bar 42 and the pressure fingers 44 forming hinge joints 45 which corresponds in function to that of the pins 16 in FIG. 1. An overlying body 48 may be arranged over the bar 42, the outlines of said body 48 being adapted to the outlines of the bar 42 and the pressure fingers 44 incorporated therewith, so that the outwards travelling movement of the pressure fingers is restricted by the overlying body 48. On downward pressing of the press 40, just as with the hereinbefore-described downward pressing of the press 10, a movement forcing the engaging surfaces 46 apart is again achieved, when the pressure fingers 44 swivel about the hinge points 45 until they come up against the overlying body 48.

Figure 3:
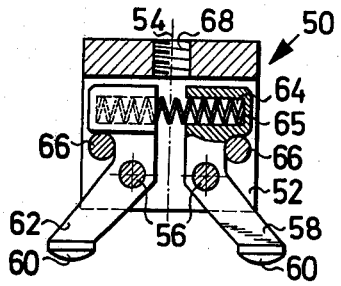

A further embodiment of the invention is represented in FIG. 3. The press, denoted generally in this case by the reference numeral 50, has a press body 52 in which two pins 56 are mounted, similarly to the pins 16 in FIG. 1, symmetrically to the longitudinal axis 54 of the body, the pins 56 serving as bearings for pressure fingers 58 corresponding to the pressure fingers 18 of FIG. 1. At their free ends the pressure fingers 58 again run out into engaging surfaces 60 with a material which has a high coefficient of friction. The pressure fingers 58 with extensions 62 jut out beyond the bearing points with the pins 56, the extensions 62 having at their free ends blind bores 64 which face one another and hold a spring 65 serving for return of the pressure fingers 58 to their original positions after displacement thereof. The extensions 62 limit the outward travelling movement of the pressure fingers 58 through the agency of stops 66. There may again be provided in the yoke of the press body a screw-thread 68, which corresponds to the screw-thread 36 of FIG. 1. The operation of the press 50 according to FIG. 3 is again basically the same as that of the press according to FIG. 1, i.e. on downward pressing of the press 50 the engaging surfaces 60 are applied on to two adjacent useful lengths, whereupon on further downward pressure the pressure fingers 58 are swung outwards about the pins 56 away from one another, against the restoring force of the spring 65. The maximum amount of the movement forcing the engaging surfaces 60 apart is in this case restricted by the mutually-opposed front surfaces of the extensions 62, while the stops 66 determine the minimum amount of said movement.

Figure 4:
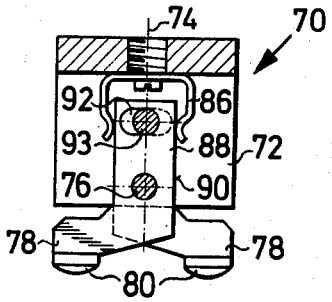

There is shown in FIG. 4 a further press generally denoted by the reference numeral 70, which illustrates how the method according to the invention can be performed in various ways. The press 70 has a press body 72 with a construction corresponding with the press bodies 12 and 52 of FIGS. 1 and 3. Two pressure fingers 78 are arranged symmetrically to the longitudinal axis, pressure fingers running at their free ends again into contact surfaces 80 of a material with a high coefficient of friction. A pin 76 serves as a common bearing for both pressure fingers 78 so that in this case the swivel axes of the two pressure fingers 78 coincide. The pressure fingers 78 project by way of extensions 88 downwardly beyond the pin 76 and the two extensions are embraced by a clamp-like spring 86 which in a manner similar to the springs 26 and 65 of FIGS. 1 and 3 seeks to bring the spread apart pressure fingers back towards one another into their initial position shown in FIG. 4, the pressure fingers being at all times in contact with the spring at their faces 90. The spring 86 may be secured to the yoke of the press body 72 in some way by means of a screw.

Similar to the projections of the pressure fingers 18 of FIG. 1, the projections 88 are also provided with longitudinal slots 92 which are penetrated by a pin 93 so that there is a restriction on the swivelling movement.

Figure 5:
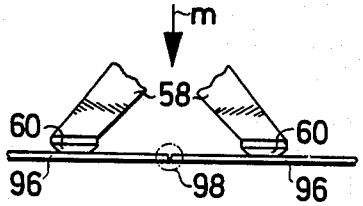
FIG. 5 illustrates the action of a severing apparatus according to the invention on two adjacent useful lengths still connected together.
Figure 6:
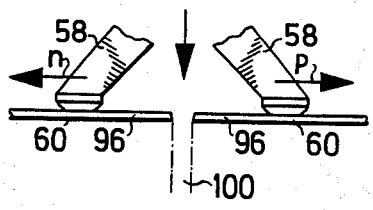
FIG. 6 illustrates the relationships of the useful lengths shown in FIG. 5 after the separation thereof.

The manner of operation of the method according to the invention is additionally schematically illustrated in FIGS. 5 and 6. Two useful lengths 96 of a sheet are connected together by small fillets 98, the sheet being acted upon in some way by the pressure fingers 58 of the press 50 according to FIG. 3, the press 50 being placed in the direction of the arrow *m* on the sheets 94 thereby located on a uniformly smooth support which is substantially nonflexible. If the press is further lowered in the direction of the arrow *m*, the hereinbefore described spreading movement, i.e. movement apart from one another, of the pressure fingers 58 takes place. These then exert oppositely directed tangential forces in the manner indicated in FIG. 6 with the arrows *n* and *p* on the adjacent useful lengths 96 through the contact surfaces 60 which always have a high coefficient of friction, so that there takes place the desired separation of the useful lengths 96 initially connected together by means of the fillets 98, just as is indicated by the gap 100 in FIG. 6. As a result of the uniformly smooth surface of the support on which the sheet 94 is placed, the useful lengths 96 may carry out sliding movement in relation to the support, and making their separation possible. As a precautionary measure, it should be pointed out that the actual pad or carrier surface preferably serves as support for the first sheet to be separated. As soon,, however, as the first sheet is taken off, the support is no longer formed directly by this pad or carrier, but by the sheet which is below the further sheets now to be separated. With increasing depth of stack there will result, as a rule to an ever decreasing degree, a displacement of the sheet due to be separated in relation to the sheets immediately therebelow, but rather to a plurality of partial displacements of all sheets forming layers in the stack, so that on separarion of the uppermost sheet the line of separaion betwen adjacent useful lengths of sheets therebelow in the stack temporarily assume, in cross-section, a long V. The separation preferably takes place so that the adjacent useful lengths arch slightly upwardly opposite the inherent stress in the material thereof and then after completion of the separating process again lose their arching due to the effect of the inherent stress in the material and return to the initial position, so that the cut edges defining the separating line again directly adjoin one another. It should also be pointed out that on separating several adjacent useful lengths, which takes place synchronously sometimes, the temporary widening of the lines of separation do not increase somewhat from the middle of the stack to the edge thereof, but are the same size for all separating lines over the whole width of the stack, as the useful lengths are drawn in to some extent as a result of the arching somewhat symmetrical to the middle line between two adjacent separating lines, and thus are reduced in their width.

The foregoing experiments refer fundamentally to adjacent useful lengths being connected together through fillets which extend transverse to the feed direction. This is essentially the more frequent situation, whereas an interconnection of the useful lengths through fillets extending in the feed direction seldom arises in practice. When this is the case, the separation can however take place exactly in the same way as has hereinbefore been described for fillets extending in the transverse direction.

Figure 7:
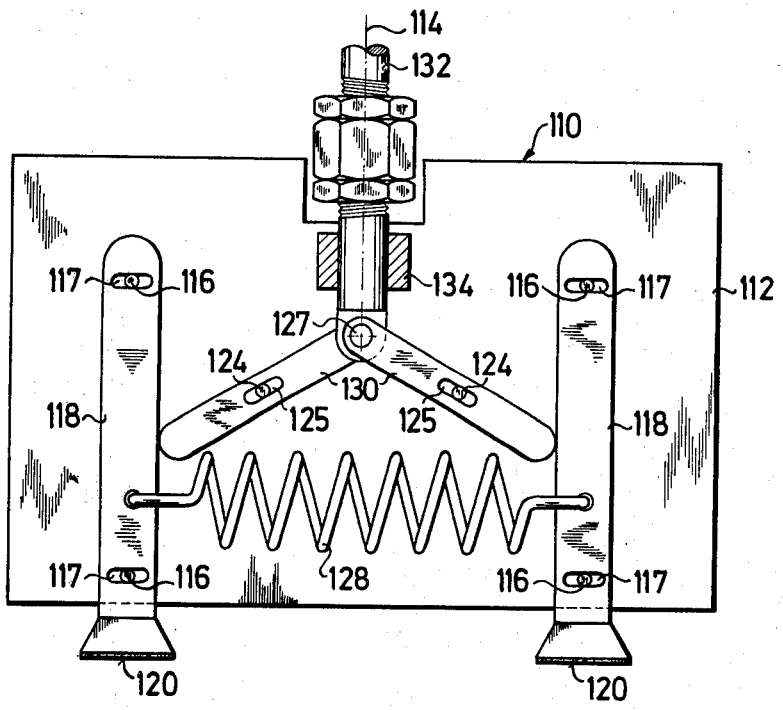
FIG. 7 is a schematic elevation of severing apparatus according to the invention constructed in accordance with a somewhat different principle.

In FIG. 7 there is shown a further embodiment of an apparatus for carrying out the method according to the invention. Due to this apparatus it is likewise possible by lowering the press here denoted generally by reference numeral 110, to exert a spreading movement on adjacent interconnected useful lengths or to have oppositely directed tangential forces exerted thereon. In contrast to the apparatuses according to FIGS. 1 to 4, the pressure fingers denoted in this case by the reference numeral 118 are, however, not swivelled but are moved parallel to themselves in a plane perpendicular to the principal plane of the useful lengths and to the separating line thereof. The two pressure fingers 118 are arranged symmetrically to the longitudinal axis 114 of the press body 112 and are guided by pins 116 engaging in elongate slots 117. Between the two pressure fingers 118 there is inserted a spring 128 which seeks to pull the pressure fingers 118 towards one another, so that the pins 116 at times butt against the outer ends of the elongate slots 117. A plunger 132 is guided to be longitudinally displaceable in a guide 134 secured to the press body 112, the plunger at its lower end in FIG. 7 being coupled with the two inner ends of toggle levers 130. The toggle levers 130 have elongate slots 125 which guide pins 124 engage. The outer free ends of the toggle levers 130 slidingly engage the inner surfaces of the pressure fingers 118, so that when the plunger 132 is pressed downwardly, the free ends of the toggle lever 130 then act in a cam-like manner of the pressure fingers 118 and the sought for spreading of the pressure fingers 118 is brought about.

Figure 8:
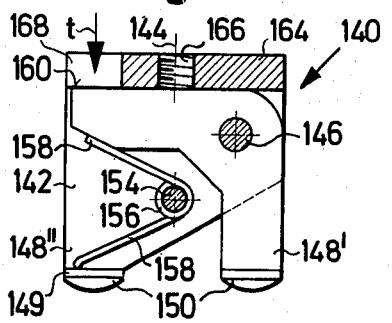
FIG. 8 is a side sectional elevation of a further modified embodiment of apparatus for carrying out the method according to the invention.

A further embodiment of an apparatus for carrying out the method according to the invention is shown in FIG. 8 and is fundamentally of a similar construction as the apparatuses of FIGS. 1 to 3 in particular, but differentiates over the latter in that only one movable pressure finger 148′ is provided, while the other pressure finger 148″ is a direct component part of the press body 142. The press denoted in this instant generally with reference numeral 142 has a longitudinal axis 144 at one side of which a pin 146 extends and serves as the bearing foor the pressure finger 148', then the pressure finger 148' at its free end extends into a contact surface 150 just as does the "stationary" pressure finger 148''. The press body 142, just as is the case with the press bodies of the apparatuses according to FIGS. 1, 3 and 4, has somewhat the cross-section of an inverted U, with a yoke 164 and lateral limbs branching therefrom, both the already mentioned pin 146 and also the journal 154, which serves as a fulcrum for a spring 156, extending between the adjacent lateral limbs. The spring 156 engages with its two arms 158, with initial stress, the inner surface of a foot 149 which supports the contact surface 150 and is mounted at the lower end of the pressure finger 148'', as well as the inner side of the angle lever with the pressure finger 148' so that the latter is pressed with one face 160 against the inner surface of the yoke 164. A screw-thread 166 is again provided in the yoke 164 and the press 140 can be secured by means thereof. There may be a lateral clearance or recess 168 in the yoke 164, so that the whole press 140 can be brought with the two contact surfaces 150 on to adjacent useful lengths and finally a force in the direction of the arrow *t* can be exercised by the pressure finger 148' on the face 160 of the angle lever, and this force swivels the pressure finger 148' in the counter-clockwise direction and thus brings about the desired spreading movement between the adjacent useful lengths. After disappearance of the force signified by the arrow *t*, the pressure finger 148'' is brought back, in the clockwise direction, into its original position by the action of the spring 156. On use of the press 140 the limiting edge of the useful length bordering on the separating line and which is below the contact surface 150 of the pressure finger 142 does not undergo any displacement, whereas the adjacent limiting edge of the useful length which is below the contact surfaces 150 of the pressure finger 148' accomplishes not only half of the spreading movement, (as in the previously described cases), but accomplishes the full spreading movement.

Figure 9:
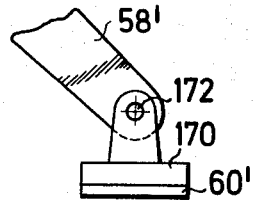
FIG. 9 is an elevation, on a larger scale, of part of a detail of a further modified embodiment of apparatus for carrying out the method according to the invention.

A further modified embodiment of the invention is disclosed in FIG. 9, and in this embodiment, the contact surfaces 20, 60, 80 and 150 are not rounded in form, in order thus to make possible a rolling movement of the contact surfaces on the useful lengths on lateral movement thereof, but the contact surface denoted in this case by 60' is level in form but is a component part of a headpiece 170 which is connected by way of a hinge pin 172 with a pressure finger denoted in this case with 58' and which corresponds somewhat with the pressure finger 58 of FIG. 3. Thereby there is made possible a flat contact of the pressure finger with the length to be separated over the full spreading movement and thus contact with a larger effective surface.

Figure 10:
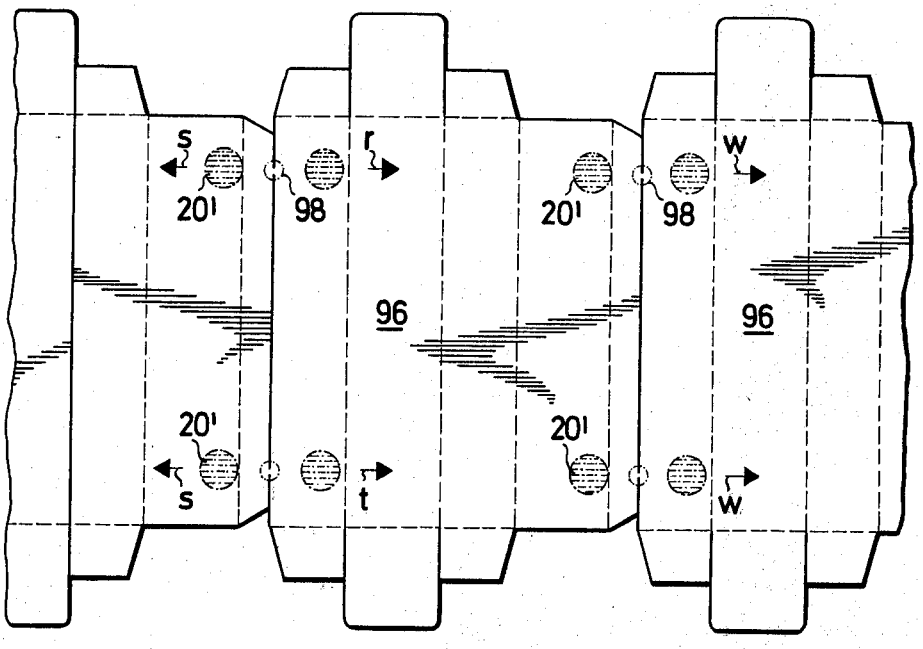
FIG. 10 is a schematic plan view of adjacent useful lengths interconnected by fillets.

Finally, FIG. 10 shows again schematically, a plan of three adjacent useful lengths 96 connected together by fillets 98 extending in the direction transverse to the feed direction. The point of contact of the pressure fingers of the press are denoted with the surface 20', a pair of contact surfaces 20' adjacent a fillet 98 corresponding to a press. The arrows *r* and *s* indicate the tangential forces becoming effective on downward pressure on the press 10, 50, 70 or the lateral displacements resulting therefrom, while the arrows *w* denote the displacement which takes place on use of the press 140. As already mentioned, the forces corresponding to the arrows *r*, *s* (and likewise also corresponding to the arrow *w*) may, moreover, be brought about, instead of by downward pressing and the press 10, 50, . . . also by means of additional force generating devices such as small lifting cylinders or the like.

The contact surfaces 20, 60, . . . of the different presses may be formed instead of from a rounded layer of rubber, also by suction cups witrh the help of which good transmission of power in the tangential direction is likewise possible.

I claim:

1. Apparatus for severing adjacent lengths of sheet material connected together by fillets and having a first surface disposed on a substantially stationary support, said apparatus comprising, a pair of pressure fingers mounted in said apparatus in a first position, said pressure fingers comprising contact surfaces adapted to engage a second surface of said adjacent lengths of material, displacing means for laterally displacing said pressure fingers from said first position and away from each other to a second position when said contact surfaces are engaged with said second surface of said lengths of material, and return means for returning said pressure fingers from said second postion to said first position, said contact surfaces having a first coefficient of friction and said support having a second coefficient of friction such that friction created between said contact surfaces and said second surface of said lengths of material is greater than the friction created between said first surface of said lengths of material and said support, whereby said adjacent lengths of material will be severed along said fillets upon lateral displacement of said pressure fingers when said contact surfaces are engaged, respectively, on adjacent lengths of said material.

2. The apparatus of claim 1 wherein said displacing means is operative upon engagement of said contact surfaces with said sheet material and the application of a force on said displacing means in the direction of said sheet material.

3. The apparatus of claim 2 wherein said return means are operative upon release of said force on said displacing means in the direction of said sheet material.

4. The apparatus of claim 1 further comprising stop means operative to limit the maximum displacement of said pressure fingers.

5. The apparatus of claim 1 wherein said displacing means comprises spring means.

6. The apparatus of claim 1 wherein said contact surfaces are formed of rubber.

7. The apparatus of claim 1 wherein said pressure fingers are swivably mounted about axes substantially parallel to the principal plane defined by said contact surfaces.

8. The apparatus of claim 7 wherein the swivel axes of said pressure fingers coincide.

9. The apparatus of claim 1 wherein said pressure fingers are formed integrally as plate springs.

10. The apparatus of claim 1 wherein said displacing means displace said pressure fingers parallel to each other in a plane substantially perpendicular to the principal plane defined by said sheet material and substantially parallel to the plane defined by the separating line between said adjacent lengths.

* * * * *